United States Patent [19]

Pierce

[11] Patent Number: 4,594,745

[45] Date of Patent: Jun. 17, 1986

[54] APPARATUS FOR CLEANING CHIMNEYS

[76] Inventor: Larry D. Pierce, Rte. 2, Box 155, Pawhuska, Okla. 74056

[21] Appl. No.: 693,354

[22] Filed: Jan. 22, 1985

[51] Int. Cl.[4] ..... F23J 3/00

[52] U.S. Cl. ..... 15/92; 15/104.14; 15/243; 134/8

[58] Field of Search ..... 15/89, 91, 92, 93 R, 15/104.09, 104.14, 242, 243, 249; 29/81 E, 81 F; 134/8

[56] References Cited

U.S. PATENT DOCUMENTS

| | | | |
|---|---|---|---|
| 1,181,616 | 5/1916 | Sandblom | 15/104.14 |
| 2,465,921 | 3/1949 | Peters | 15/104.14 |
| 2,641,791 | 6/1953 | Wells | 15/243 |
| 2,838,779 | 6/1958 | Craig et al. | 15/104.14 X |
| 3,996,637 | 12/1976 | Shibata et al. | 15/104.14 X |
| 4,002,491 | 1/1977 | Esparza | 15/91 X |

FOREIGN PATENT DOCUMENTS

| | | | |
|---|---|---|---|
| 417180 | 8/1925 | Fed. Rep. of Germany | 15/104.14 |
| 991092 | 10/1951 | France | 15/104.14 |

*Primary Examiner*—Edward L. Roberts

*Attorney, Agent, or Firm*—Head, Johnson & Stevenson

[57] ABSTRACT

This invention relates to the cleaning of chimneys such as those of wood burning fireplaces. An electric motor is supported from a frame. In one mode of operation, the frame is supported in a chimney by a long rod which is along the line of the axis of the shaft of the motor. A plurality of fixed chain links are welded to the plate on the shaft. Each fixed link has a second chain link attached thereto in the normal chain articulation manner. Each second link has a ball welded at the outer end. As the motor turns, the steel balls strike the build-up of deposits on the chimney walls and quickly cleans it as the device is raised and lowered by an operator using the long rod. The frame is also such that it can be turned sideways so that the shaft is horizontal. This is helpful in getting certain corners in certain type chimneys.

4 Claims, 5 Drawing Figures

APPARATUS FOR CLEANING CHIMNEYS

BACKGROUND OF THE INVENTION

The field of this invention is in the cleaning of chimneys and especially those chimneys which have wood burning fireplaces or stoves although it is applicable to the cleaning of any chimney upon which deposits form as a result of combustion.

When burning wood in a fireplace, for example, there is a continual build-up of deposits, such as creosote, on the walls of the chimney connected to the fireplace. The more deposits which build up, the greater is the hazard of a fire developing in the chimney itself due to combustion of the deposits. It is therefore a safety procedure to periodically remove the deposits. A common conventional way of removing the deposits is by brushing. This can take various forms such as pulling a tight fitting brush through the chimney itself to knock off the deposits. This is fairly time consuming and not as satisfactory as desired. Some of the deposits on the chimney wall become very hard and are thus exceedingly difficult to remove by the conventional brush method.

In addition to the conventional method of removing the deposits as just described, another method is described in U.S. Pat. No. 2,041,779 which is a flue cleaning device for heating furnaces and as such is different from the cleaning of regular fireplace chimneys. That patent includes a plurality of chains which are loosely suspended from the arms 25 forming a spider carried by the vertical shaft 26 which is rotatable. This appears to be a permanent attachment to a flue and, as such, would not be suitable for a chimney sweep to use in cleaning chimneys in several different dwellings or buildings.

BRIEF SUMMARY OF THE INVENTION

This is a portable apparatus for cleaning chimneys. A motor having a shaft with a longitudinal axis is supported by a frame which has a first connector for connecting a long rod or rods which is substantially aligned with the longitudinal axis of the motor. At the shaft end of the motor, there is provided the cleaning mechanism proper. This includes a plurality of fixed chain links which are fixed to the shaft and perpendicular thereto. Each such fixed chain is provided with a second chain link connected in the ordinary manner. Each such chain link has as its outer end, a hardened steel ball welded thereto. The length of these fixed and loose links are such that the balls, when rotated, extend beyond the frame so that they can make contact with the wall of the chimney.

When it is desired to use this to clean the chimney, a number of rods as necessary, is added to the rod connector and power is supplied to the motor. As the motor turns, the tool is raised and lowered by the chimney sweep through the chimney at a rate so that the balls can knock off essentially all of the deposit. When in this position, the balls rotate in a horizontal plane.

Sometimes it may be desired to have the balls rotated in a substantially vertical plane. This can be accomplished by rotating the frame 90° to where a second rod connector extends upwardly and the rod is connected to that connector. When the motor is actuated, the balls rotate in a vertical plane. The rod is moved so that the cleaning device moves vertically and/or horizontally as desired to effect cleaning. This feature is helpful in cleaning some type chimney flues which have corners with a radius which is difficult for the tool to reach into when it is in its position so that the chains rotate in a horizontal position.

It is an object of this invention to provide a chimney cleaning device which will rapidly remove even hardened deposits from the wall of the chimney. Various other objects and a better understanding of the invention can be had from the following description taken in conjunction with the drawings.

DRAWINGS

DETAILED DESCRIPTION OF THE PREFERRED EMBODIMENT

Figure 1:
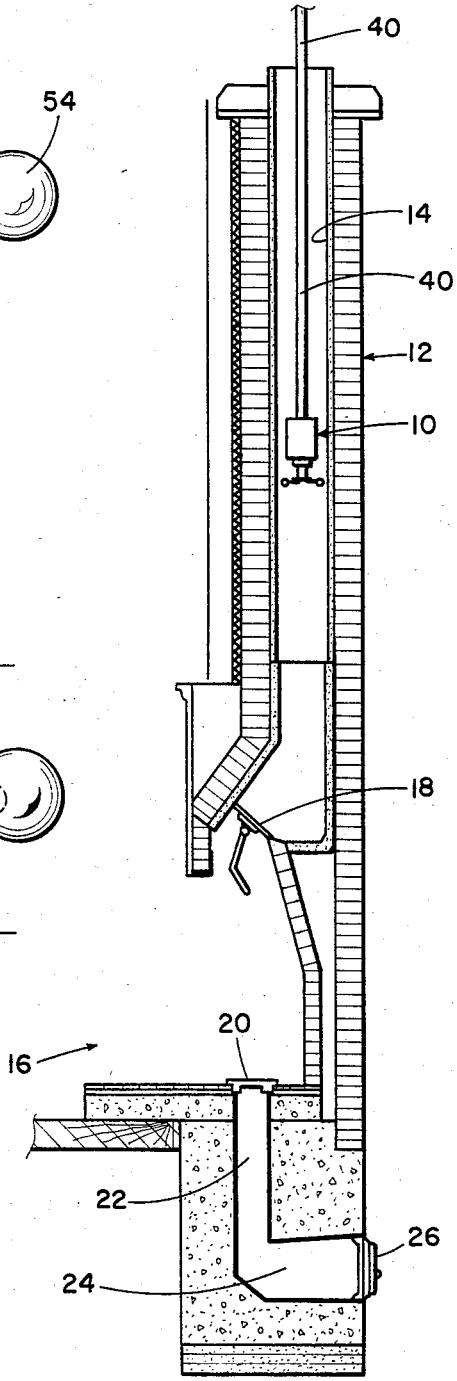
FIG. 1 illustrates my invention in position in a chimney.
Figure 3:
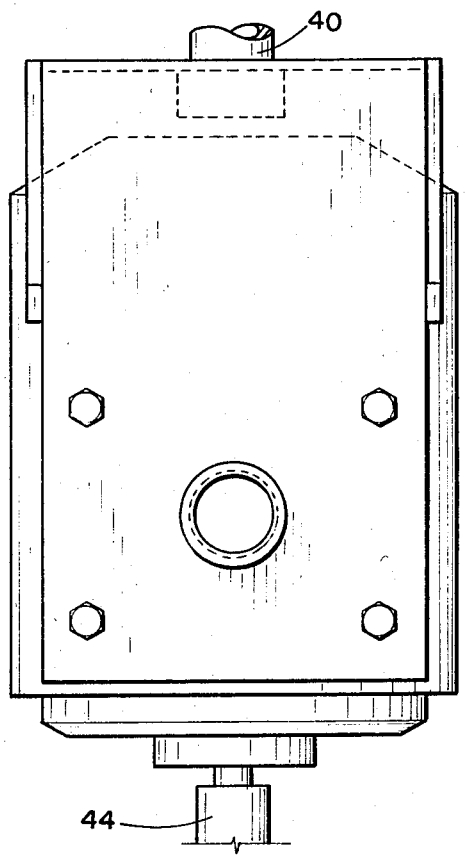
FIG. 3 is similar to FIG. 1 except it is taken along the line 3—3 of FIG. 2.

Attention is first directed to FIG. 1 which illustrates my invention 10 suspended within a chimney 12 having internal walls 14 upon which deposits form when a fire is burned in the fireplace generally designated 16. The fireplace mechanism has a damper 18 and an ash outlet which includes door 20 in the floor of the fireplace proper, vertical passage 22, collecting cavity 24 and door 26 which is preferably outside the structure or home for removal of the ashes.

Figure 2:
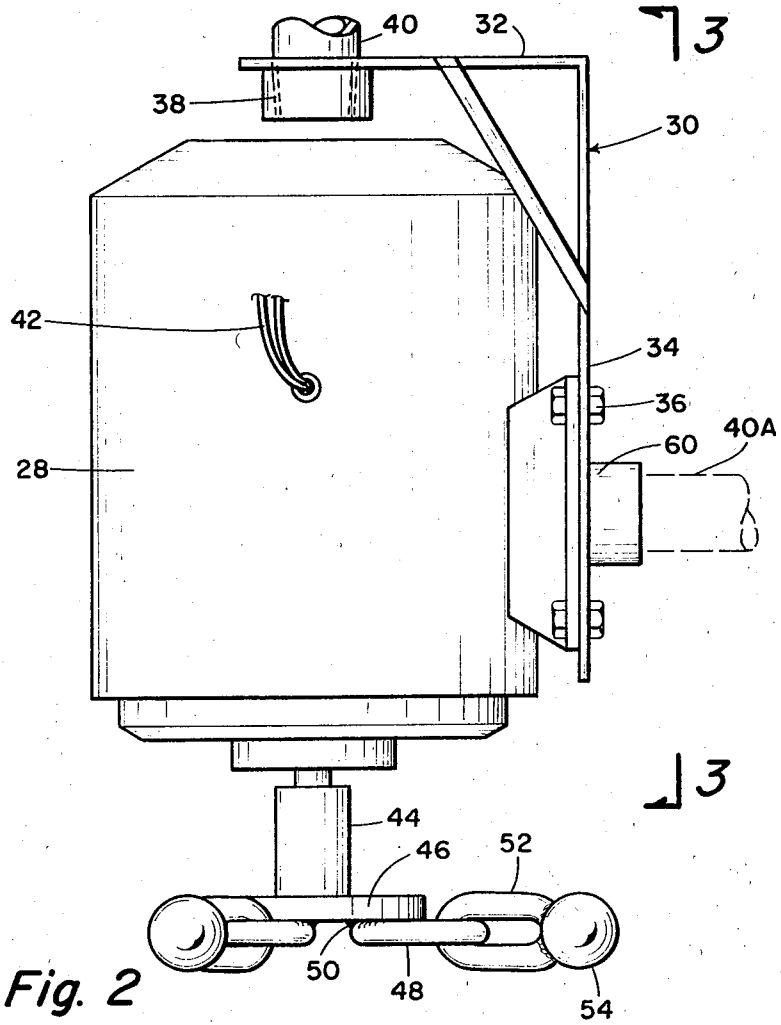
FIG. 2 is an enlarged full face view of my invention.

Attention is next directed to FIG. 2 which shows a full face view of my chimney cleaning device and it shows a motor 28 supported by a frame 30 which has a horizontal frame 32 and a vertical frame section 34. The motor can be mounted to the frame in any conventional manner such as by bolts 36. Frame section 32 has a rod connector 38 for connecting to rod 40 as shown in FIG. 1. These rods 40 may be made up in sections so that it has adequate length for the chimney which is to be cleaned. Connector 38 may be, for example, a ½ inch pipethread half collar welded to the frame section 32. Electrical lines 42 are provided for powering the motor 28. They are connected to a power source and means are not shown to permit the operator to start and stop the motor.

Figure 5:
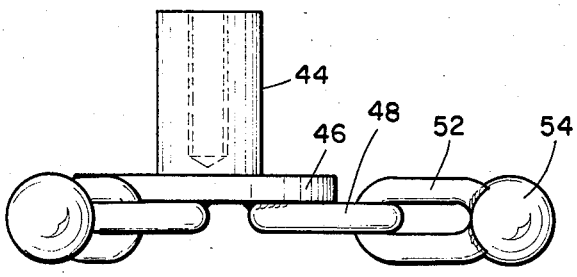
FIG. 5 is similar to FIG. 5 except that it is a horizontal view.
Figure 4:
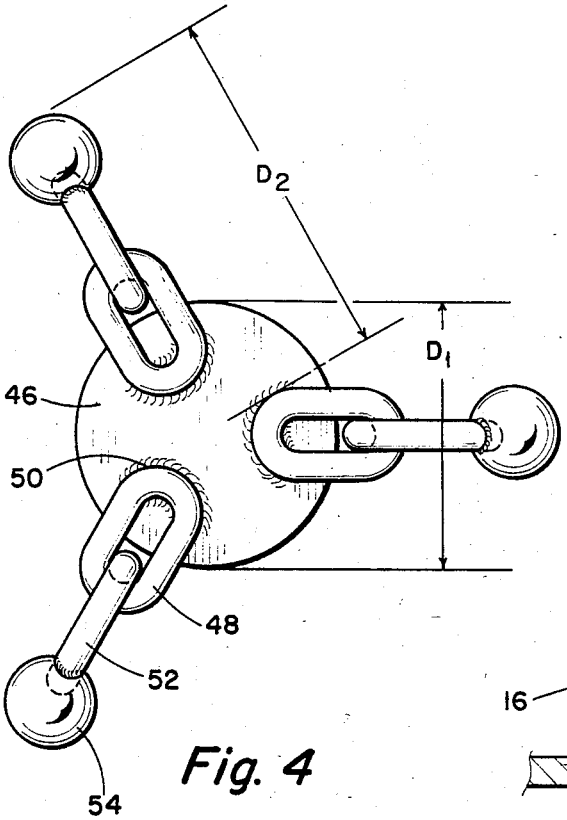
FIG. 4 shows the full face view of the cleaning balls connected to the shaft plate.

A shaft 44 extends out the lower end of motor 28 and is provided with a plate 46. Attached to the plate 46 is a plurality of chain links 48 which are attached thereto by welding 50. The chain links 48 are preferably laid "flat" against plate 46 such that the plan of such links is perpendicular to shaft 44. Each link 48 is provided with a second link 52 which articulately connected to fixed link 48 in the usual way for connecting chain links. A hardened ball 54 has been welded to link 52. The actual cleaning portion of the mechanism is shown also in FIGS. 4 and 5. FIG. 4 is a bottom view. I have built several of these and the typical deminsions are for $D_1$ the diameter of plate 46 is 2.250 inches and the diameter from the center of the plate 46 to the exterior of the ball 54 is $D_2$ and typically is 3.0625 inches. A typical diameter of the ball is 0.750 inches. In this tool, the diameter of the circle defined by the balls 46 in a rotating cleaning position is 6.125 inches. The length $D_2$ is such that in operation when the balls 54 are in their extended position, they extend beyond the frame and motor so that they can contact the wall of the chimney directly.

In operation, the chimney sweep stands on the top of the chimney and attaches rod 40 to cleaning device 10. The chimney sweep then actuates the motor causing it to rotate and at the same time, he raises or lowers the rod 40 so that the balls 54 can contact all of the interior walls 14 of the chimney 12 and remove all of the deposits. The deposits which are knocked off by the balls are then removed from the chimney in any conventional manner. In operation it will be noted that my balls 54 are attached to links 52 which, when they hit the wall, they can rotate backwardly about the point where it is connected to the fixed link 48. This type connection tends to hold the balls 54 in the desired plane during operation and also reduces the chance of the balls 54 breaking the wall of the chimney.

The chain links are high test chain, a typical one being ¼ inch of High Test Chain grade 4 C101H.T. and the ball 54 can be an alloy steel ball heat treated 50-52C.

With the tool in the operating position as shown in FIG. 1, the balls 54 rotate in a horizontal plane. Occasionally, it will be desired to have these rotate in a vertical plane. This is sometimes necessary to get into "corners" of certain type chimneys. This can be accomplished very easily by removing rod 40 from connector 38 and placing it in connector 60 as indicated by 40A of FIG. 2. The operation of the tool is quite similar to that described above except that the balls 54 are in a vertical plane and the tool 10 is still raised and lowered by the chimney sweep using the rod 40 and the motor is actuated in the same manner. The balls 54 can then go into corners and clean corners easier and reach corners which could not be reached if the balls are rotated in their horizontal position.

While this invention has been described with a certain degree of particularity, it is manifest that many changes may be made in the details of construction and the arrangement of components without departing from the spirit and scope of the attached claim or claims, including the full range of equivalency to which each element thereof is entitled.

What is claimed:

1. A portable chimney sweep cleaning device which comprises:

motor having a shaft with a longitudinal axis;

a rod;

a frame for holding said motor, said frame having a first rod connector for connecting said rod to said frame so that said rod extends in substantially the same direction as said axis of said shaft and a second rod connector for connecting said rod such that said rod is perpendicular to said axis;

a plurality of fixed chain lengths fixed to said shaft in a plane perpendicular to said axis;

at least one second chain link connected to each said fixed chain link in an articulated manner;

a ball fixed to the outer end of said second chain link and extending beyond the periphery of said frame.

2. A portable chimney sweep cleaning device which comprises:

a motor having a shaft with a longitudinal axis;

a plurality of fixed chain links fixed to said shaft and perpendicular to said axis, each said fixed chain link having a length shorter than the radial distance from the shaft to the periphery of said motor;

at least one second chain link connected to each said fixed chain link in an articulated manner;

frame means to support said motor and including a first rod connector aligned with the axis of said shaft and a second rod connector on the side thereof and aligned such that its axis is perpendicular to the axis of said shaft;

a ball fixed to the outer end of said second chain link and extending beyond the periphery of said motor and said frame means.

3. A portable chimney sweep cleaning device which comprises:

a motor having a shaft with a longitudinal axis;

a plurality of secured chain links secured to said shaft, each said secured chain link having a length shorter than the radial distance from the shaft to the periphery of said motor;

at least one chain link connected to each said secured chain link in an articulated manner;

frame means to support said motor, said frame means including a first rod connector aligned with the axis of said shaft and a second rod connector on the side thereof and aligned such that its axis is approximately perpendicular to the axis of said shaft.

4. A portable chimney sweep cleaning device which comprises:

a motor having a shaft with a longitudinal axis;

a plurality of fixed chain links fixed to said shaft and lying flat in a plane perpendicualr to said axis, each said fixed chain link having a length shorter than the radial distance from the shaft to the periphery of said motor;

at least one second chain link connected to each said fixed chain link in an articulated manner;

frame means to support said motor;

a ball fixed to the outer end of said second chain link and extending beyond the periphery of said motor and said frame means, there being only one articulated joint between each ball and the shaft.

* * * * *